US006606531B1

(12) United States Patent
Leibinger et al.

(10) Patent No.: US 6,606,531 B1
(45) Date of Patent: Aug. 12, 2003

(54) SHEET MATERIAL LOADER/UNLOADER FOR MACHINE TOOLS

(75) Inventors: Peter Leibinger, Avon, CT (US); Leonid Zeygerman, West Hartford, CT (US)

(73) Assignee: Trumpf, Inc., Farmington, CT (US)

( * ) Notice: Subject to any disclaimer, the term of this patent is extended or adjusted under 35 U.S.C. 154(b) by 0 days.

(21) Appl. No.: 10/068,996

(22) Filed: Feb. 7, 2002

(51) Int. Cl.[7] ..... G06F 19/00
(52) U.S. Cl. ..... 700/114; 156/364; 271/228
(58) Field of Search ..... 271/227, 228, 271/306; 156/302, 304; 700/114; 83/151

(56) References Cited

U.S. PATENT DOCUMENTS

| | | | | |
|---|---|---|---|---|
| 3,830,121 A | | 8/1974 | Makeev et al. | |
| 4,709,605 A | * | 12/1987 | Clark | 271/227 |
| 5,234,207 A | * | 8/1993 | Lindstrom et al. | 271/11 |
| 5,765,984 A | | 6/1998 | Stefano et al. | |
| 5,941,673 A | | 8/1999 | Hayakawa et al. | |
| 6,125,901 A | * | 10/2000 | Englisch et al. | 156/362 |
| 6,240,705 B1 | * | 6/2001 | Simmons et al. | 52/237 |

FOREIGN PATENT DOCUMENTS

| | | |
|---|---|---|
| DE | 3136544 A1 | 3/1983 |
| DE | 29516304 A1 | 3/1996 |
| DE | 19801918 A1 | 7/1999 |
| EP | 0 767 018 B1 | 4/1997 |
| EP | 0 945 212 A1 | 9/1999 |
| EP | 1 023 954 A1 | 8/2000 |
| EP | 1 031 397 A1 | 8/2000 |

* cited by examiner

*Primary Examiner*—Albert W. Paladini

(57) ABSTRACT

A machine tool installation includes a machine tool with a work support table, and a workpiece guidance system. Adjacent the machine tool is a sheet material loader and unloader with a frame, a platform supported on the frame for vertical movement, and a sheet material gripper mounted on the frame for movement from a position forwardly of the frame to a retracted position. A sheet pickup depends from the platform to engage the top sheet of a stack of sheets disposed therebelow. A computer control operates the elements to move a workpiece on the work support table to a position adjacent the platform, and the gripper moves the workpiece onto the lowered platform. The sheet pickup engages a sheet and the platform is moved upwardly to move the engaged sheet to a position above the plane of the work support table which is moved thereunder, and the sheet gripper deposits the sheet on the work support table.

9 Claims, 16 Drawing Sheets

Sheet Material Loader
Front View

Sheet Material Loader
Front View

Sheet Material Loader
Side View

Sheet Material Loader
Top View

SHEET MATERIAL LOADER/UNLOADER FOR MACHINE TOOLS

BACKGROUND OF THE INVENTION

The present invention relates to machine tool installations employing apparatus for automatically loading and/or unloading workpieces from a worktable upon which the workpieces are supported during processing.

Machine tools which process sheet metal and like materials generally have one or more work stations and a work support table with a guidance system for gripping and moving the workpiece on the work support table, and/or for moving the work support table or a portion thereof relative to the work station(s). Generally, the movement of the workpiece in modern machines is controlled by a computer numeric control system to precisely position the workpiece relative to the work station for the machining operation.

As the speed and efficiency of these machines has increased, there has been increasing need for devices which would automatically load the workpieces to be processed onto, and/or remove the processed workpieces from, the work support table, thus minimizing the need for operator intervention and the attendant delay in processing time.

Various devices have been proposed for use in conjunction with such machine tools in order to facilitate the loading and unloading operation. Some of these devices require separate storage of each of the unprocessed workpieces and include elements to transport the workpieces in a horizontal plane. Although these devices have proven useful, there has remained a need for a relatively simple but effective loader/unloader which can be coupled to an existing machine tool installation and operate effectively under the control of the computer numeric control for the machine tool.

Accordingly, it is an object of the present invention to provide a novel loader/unloader for sheet metal and the like for use in conjunction with a machine tool having a work support table with at least a portion movable under control of the computer numeric control of the machine tool.

It is also an object to provide such a loader/unloader which not only delivers the unprocessed workpiece to the work support table of the machine tool but also removes the processed worksheet.

Another object is to provide such a loader/unloader which effects the unloading of the processed work sheet and the loading of a fresh workpiece for processing in a sequence which is rapid and highly effective.

SUMMARY OF THE INVENTION

It has now been found that the foregoing and related objects may be readily attained in a machine tool installation having a machine tool with a work support table for supporting sheet material for movement in a horizontal plane in X and Y axes. A workpiece guidance system is included for movement of the sheet material in one of the axes on the work support table, and at least a portion of the table is movable horizontally by moving means.

A sheet material loader and unloader is disposed adjacent to the machine tool, and includes a frame, a platform supported on the frame for vertical movement adjacent the work support table portion, and means for moving the platform vertically between a position above the horizontal plane of the work support table and a position therebelow.

Sheet material gripping means is mounted on the frame for movement from a position forwardly of the frame to a retracted position, and there is provided means for operating and moving the gripping means. Sheet engaging means depends from the platform for engaging the top sheet of a stack of sheets disposed therebelow, and means is provided for operating said sheet engaging means.

Control means controls the several moving, gripping, engaging and operating means to move a sheet material workpiece on the work support table of the machine tool to a position over the platform of the loader and unloader for engagement by the gripping means in its forward position. As the work table moves away, the workpiece drops onto the platform. The sheet engaging means is operable to engage a sheet and the platform is moved upwardly to move the engaged fresh sheet material workpiece to a position above the plane of the work support table, and then the sheet engaging means deposits the sheet on the work support table portion.

Preferably, the sheet engaging means on the platform comprises suction elements and suction drawing means connected thereto and under control of the control means. The workpiece guidance system of the machine tool includes clamps to grasp the adjacent edge portions of a sheet and they are operable under control of the control means. The gripping means includes clamps to grasp the adjacent edge portions of a sheet and they are operable under control of the control means.

The machine tool has a computer controlling the operation thereof and including the control means for the moving and gripping and engaging elements of the loader and unloader.

Preferably, the frame includes stationary side members and a carriage is supported on the stationary side members and mounts the platform. The carriage is movable vertically on the side members to effect the vertical movement of the platform.

The carriage has side members with horizontal guide arms on which the platform is mounted, and it also has a bridge extending over the platform. The sheet material gripping means depends from the bridge and is supported by the bridge and movable horizontally thereon.

DETAILED DESCRIPTION OF THE ILLUSTRATED EMBODIMENT

Figure 1:
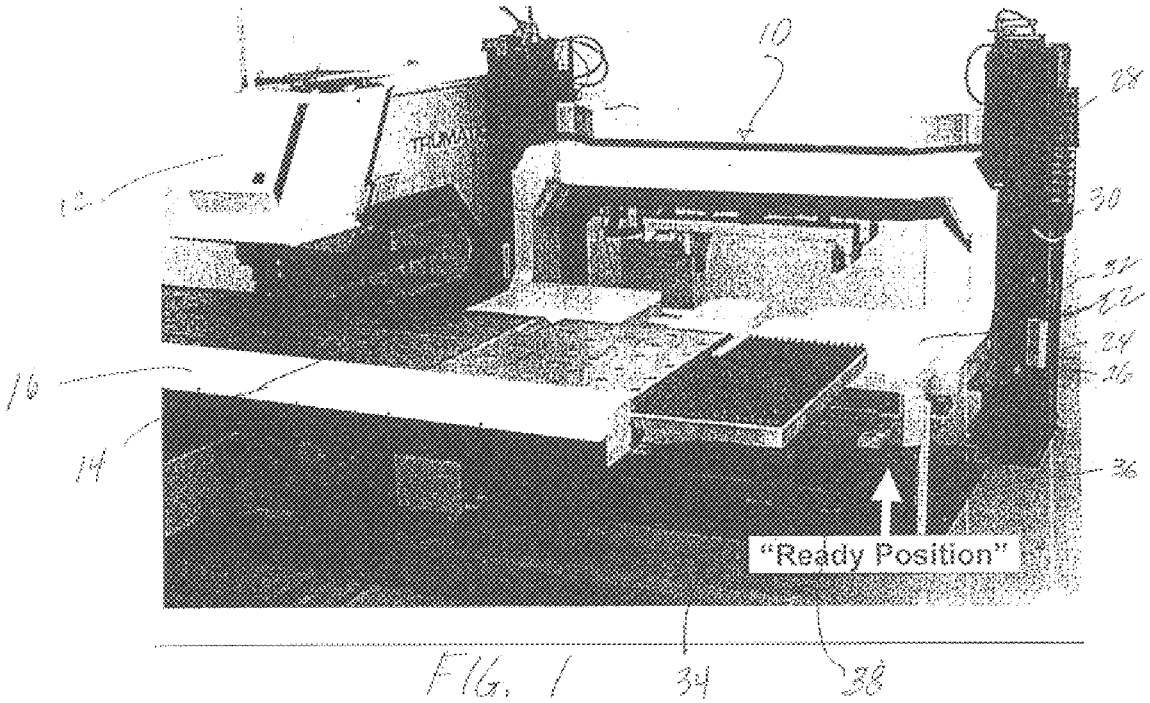
FIG. 1 is a front perspective view of a machine tool installation in which a sheet material loader and unloader embodying the present invention is being utilized in conjunction with a punch press.
Figure 2:
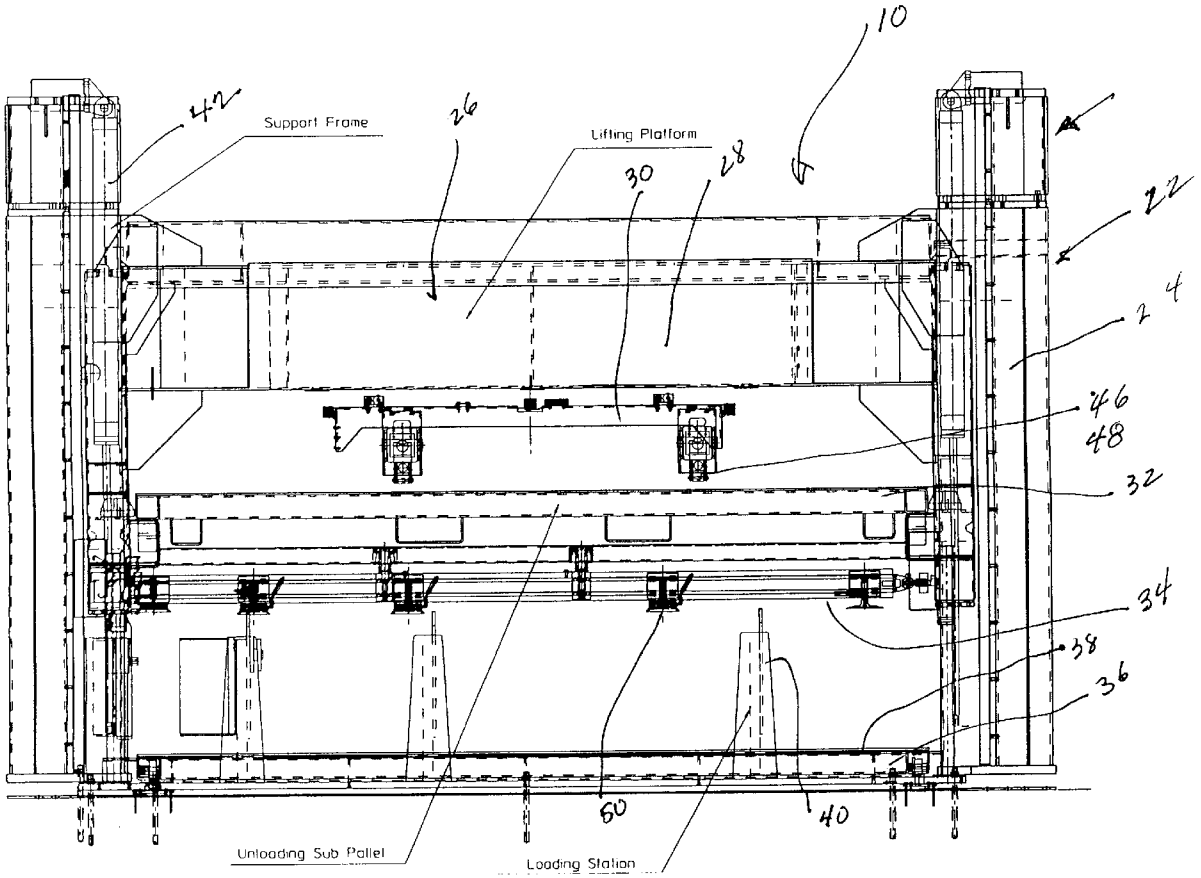
FIG. 2 is a front view of the loader and unloader of FIG. 1 with the platform in its "ready" position.
Figure 3:
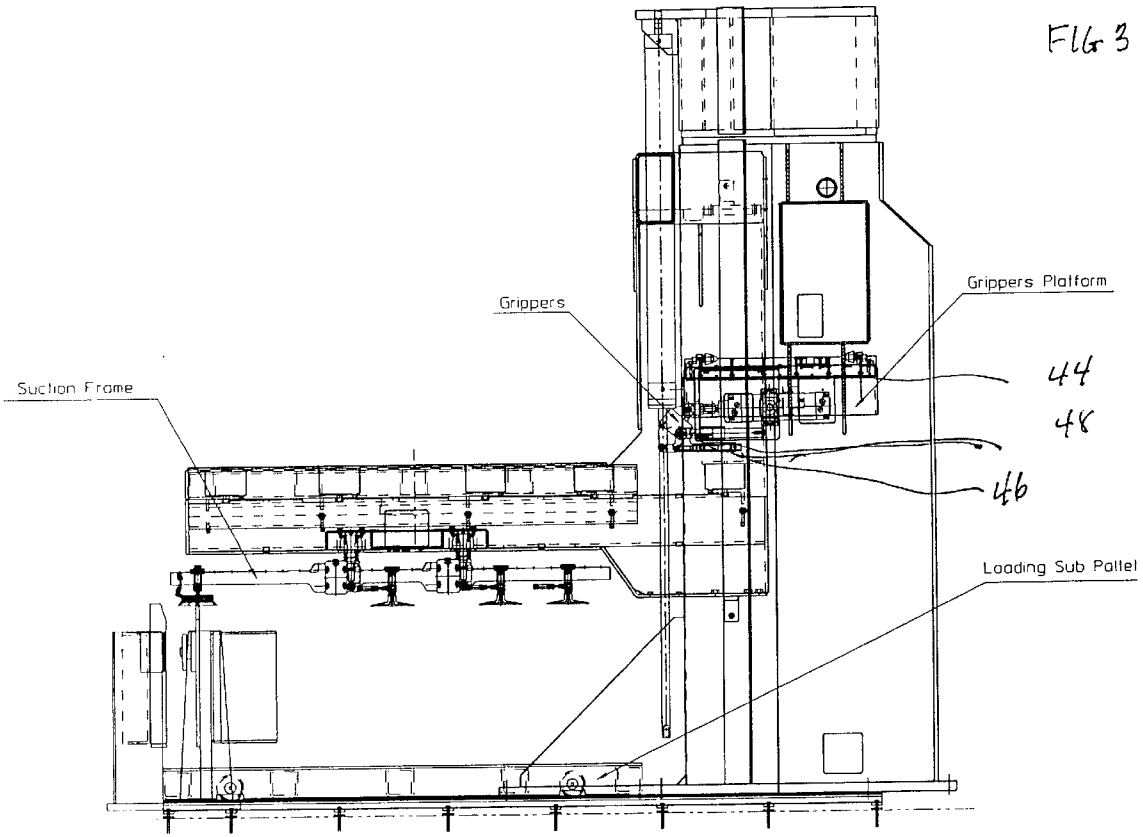
FIG. 3 is a side elevational view thereof.
Figure 4:
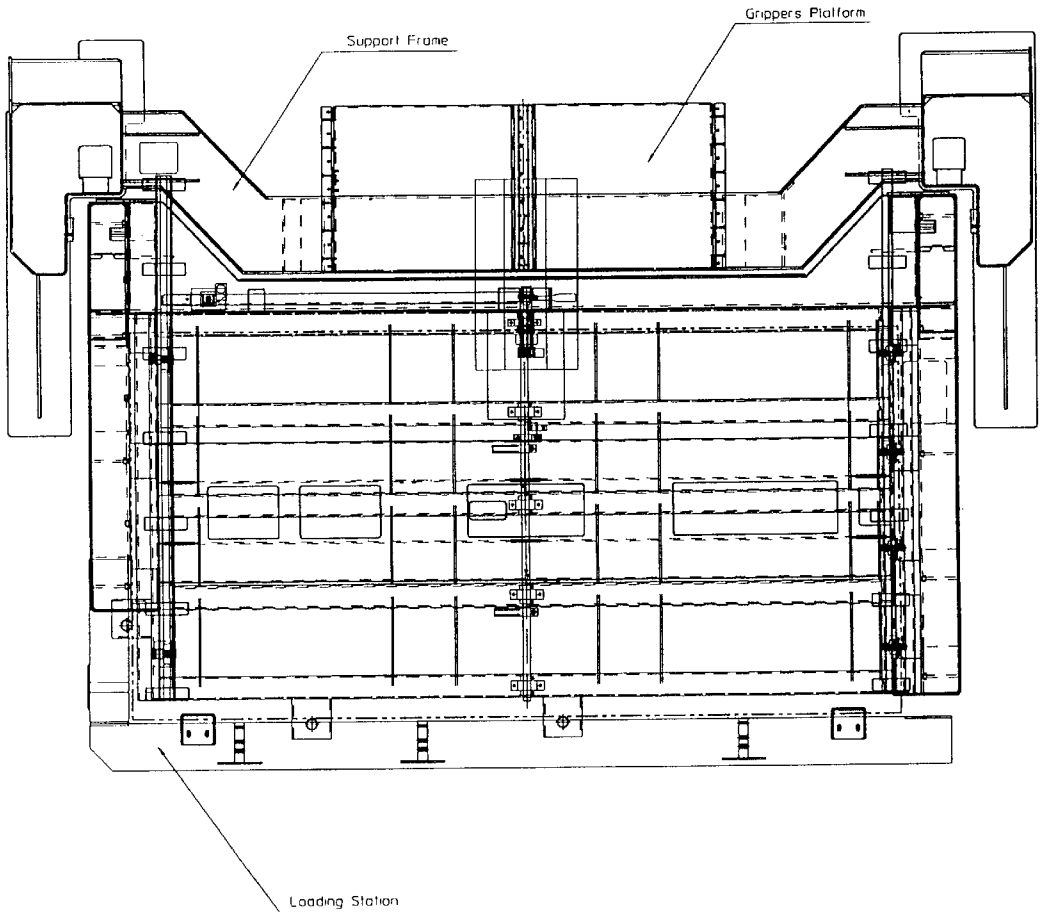
FIG. 4 is a top plan view thereof.

Turning first to FIGS. 1–4, therein illustrated is a machine tool installation incorporating a sheet material loader/unloader embodying the present invention generally designated by the numeral 10 in conjunction with a numerically controlled punch press generally designated by the numeral 12.

The punch press 12 has a work support table 14. Extending along the outer side of the work support table 14 is a guidance system 16 for gripping and moving a workpiece 18 in one axis on the work support table 14 relative to the work station under the head 20 of the punch press 12. Movement of the workpiece 18 in the other axis is effected by movement of the work table 14.

The loader and unloader 10 is generally comprised of a frame generally designated by the numeral 22 with horizontally spaced uprights 24. A carriage generally designated by the numeral 26 is movable upwardly and downwardly between the uprights 24 and includes a header 28, a gripper unit 30 and a forwardly extending platform 32 with a suction frame 34 therebelow. A pallet 36 is disposed below the platform 32 and has sheet metal workpieces 38 stacked thereon and stops 40 are provided for positioning the fresh workpieces.

The carriage 26 is moved upwardly and downwardly the hydraulic cylinders 42 on the uprights 24, and the gripper unit 30 is moved outwardly and inwardly by hydraulic cylinders 44. The gripper unit 30 has outwardly extending clamps or grippers 46 thereon which are actuated by air cylinders 48. Depending from the suction frame 34 are suction elements 50 which are connected to a vacuum source (not shown). All of the operating elements are under control of the numeric control system of the punch press 12.

Figure 5:
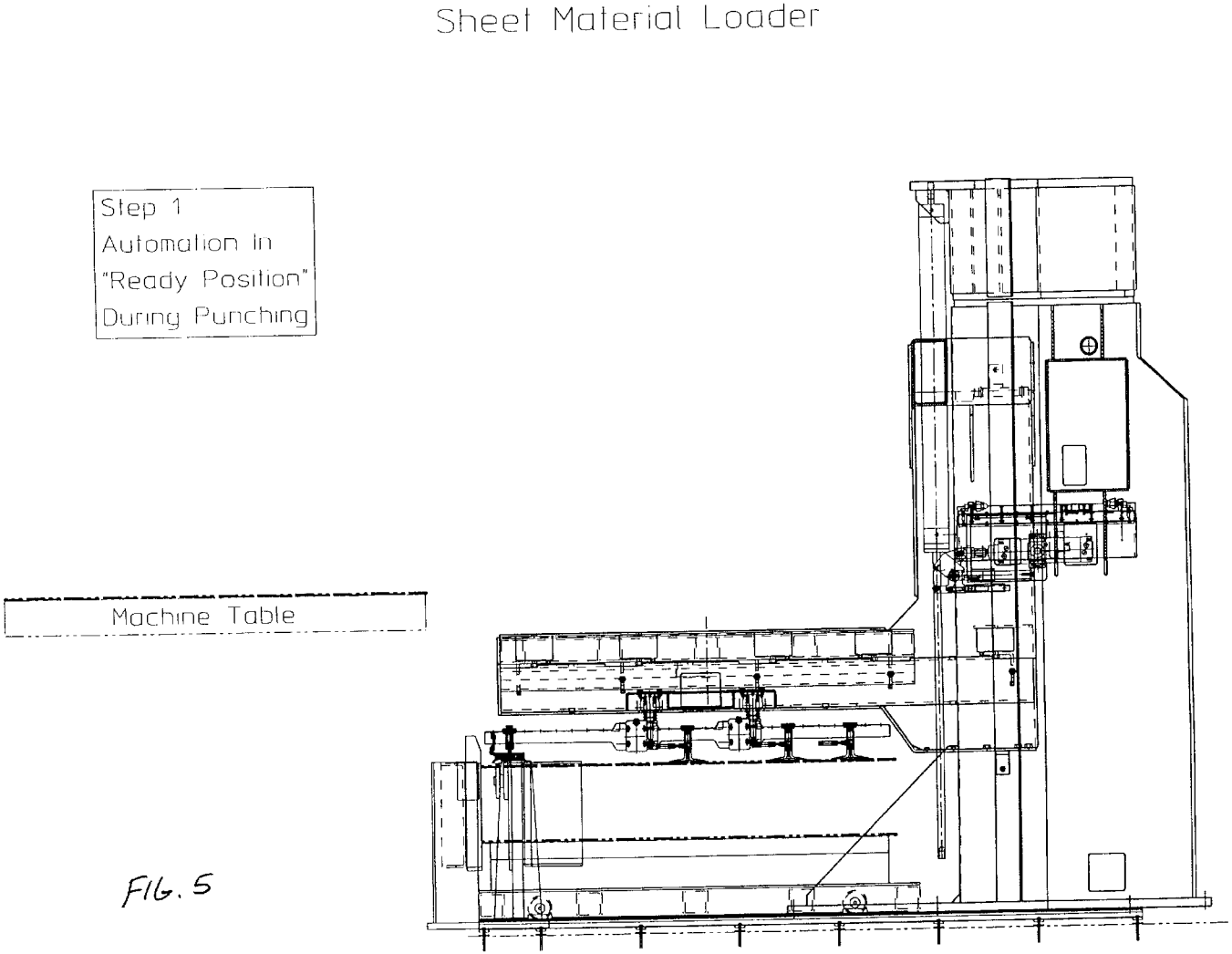
FIG. 5 is a partially diagrammatical side elevational view thereof with the platform and principal components in the "ready position" during operation of the punch press, and with the work support table of the punch press moved to the initial position for unloading the processed workpiece supported thereon.

Turning next to FIGS. 5–15, therein illustrated are the steps in the operation of the installation. In FIG. 5, the loader and unloader 10 and the movable work support table 14 are in their position following operation of the punch press 12 with the processed workpiece 18 supported on the work support table 14 and being movable thereon by the guidance system 16. In this step, the carriage 26 is partially elevated and the movable platform 32 is below the plane of the table 14. A vacuum is being applied to the suction elements 50 to carry a fresh workpiece 38 lifted from the stack of workpieces on the pallet 36. The gripper unit 30 is in its retracted position.

Figure 6:
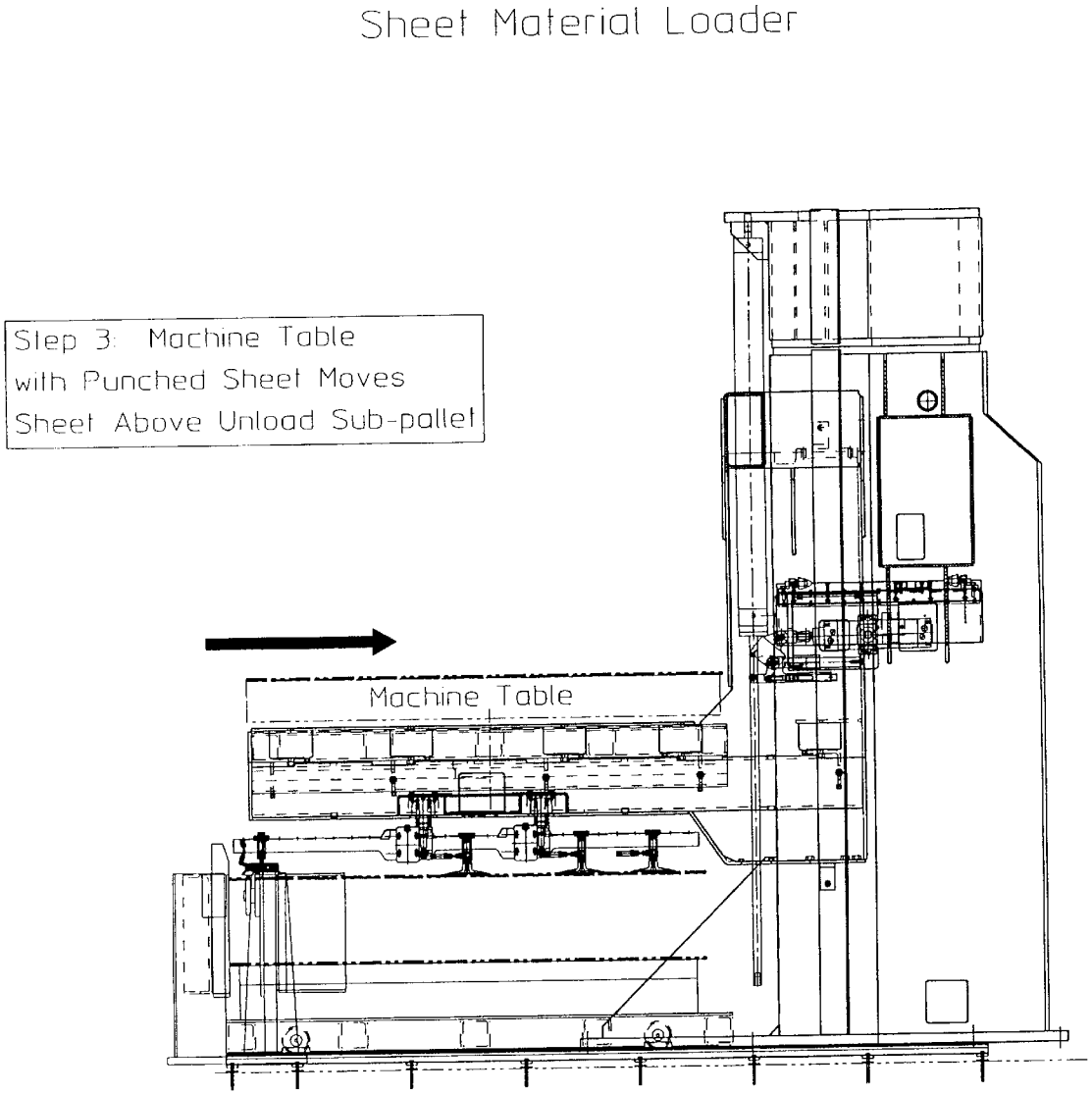
FIG. 6 is a similar view in which the work support table has moved to the unload position in which it is disposed over the platform.
Figure 7:
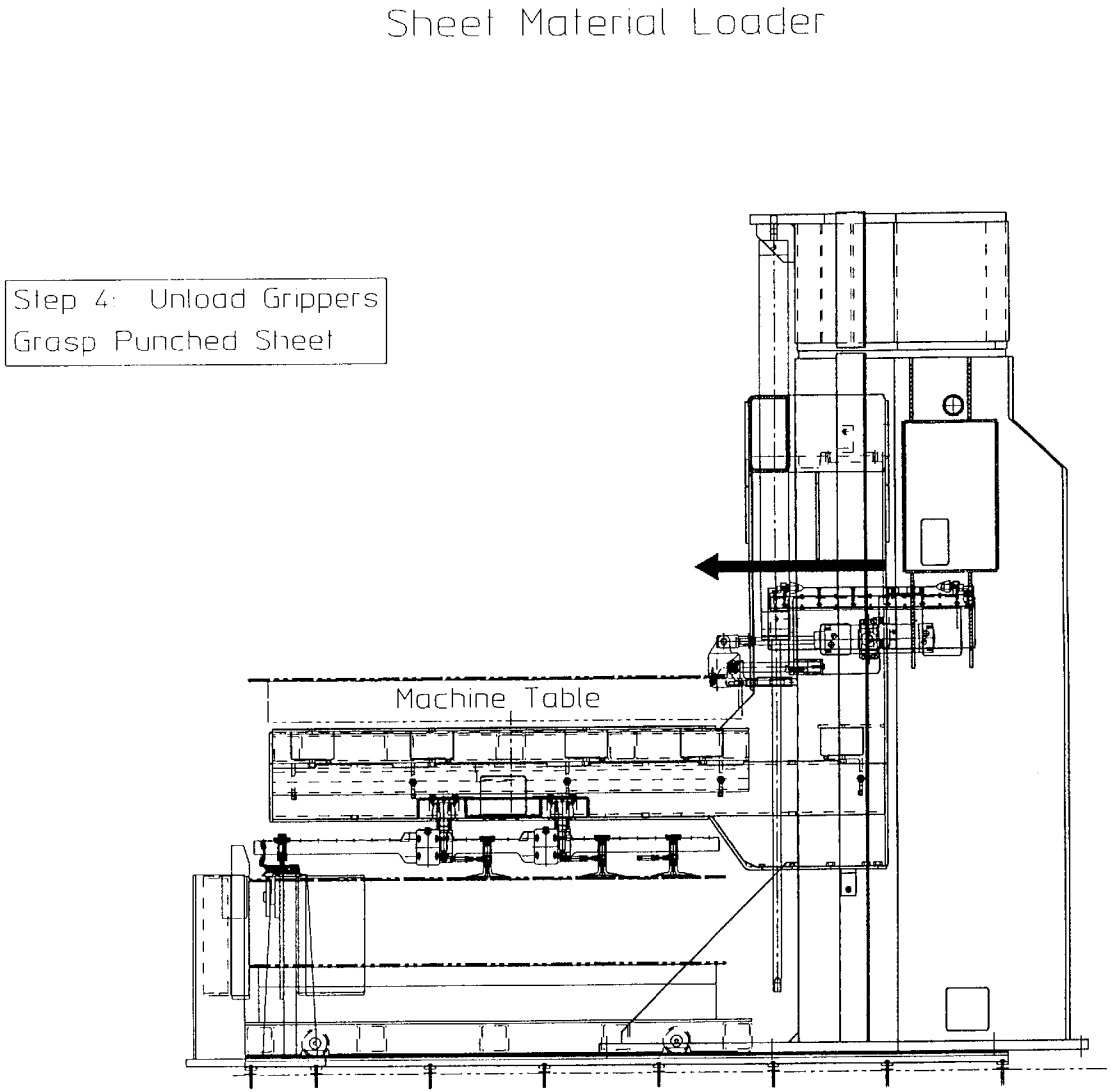
FIG. 7 is a similar view with the gripper assembly moved outwardly to grip the processed workpiece.

In FIG. 6, the movable table 14 with the processed workpiece 18 thereon has been moved over the platform 32. In FIG. 7, the gripper unit 30 has moved outwardly and the grippers 46 have been actuated to clamp the edge of the workpiece 18.

Figure 8:
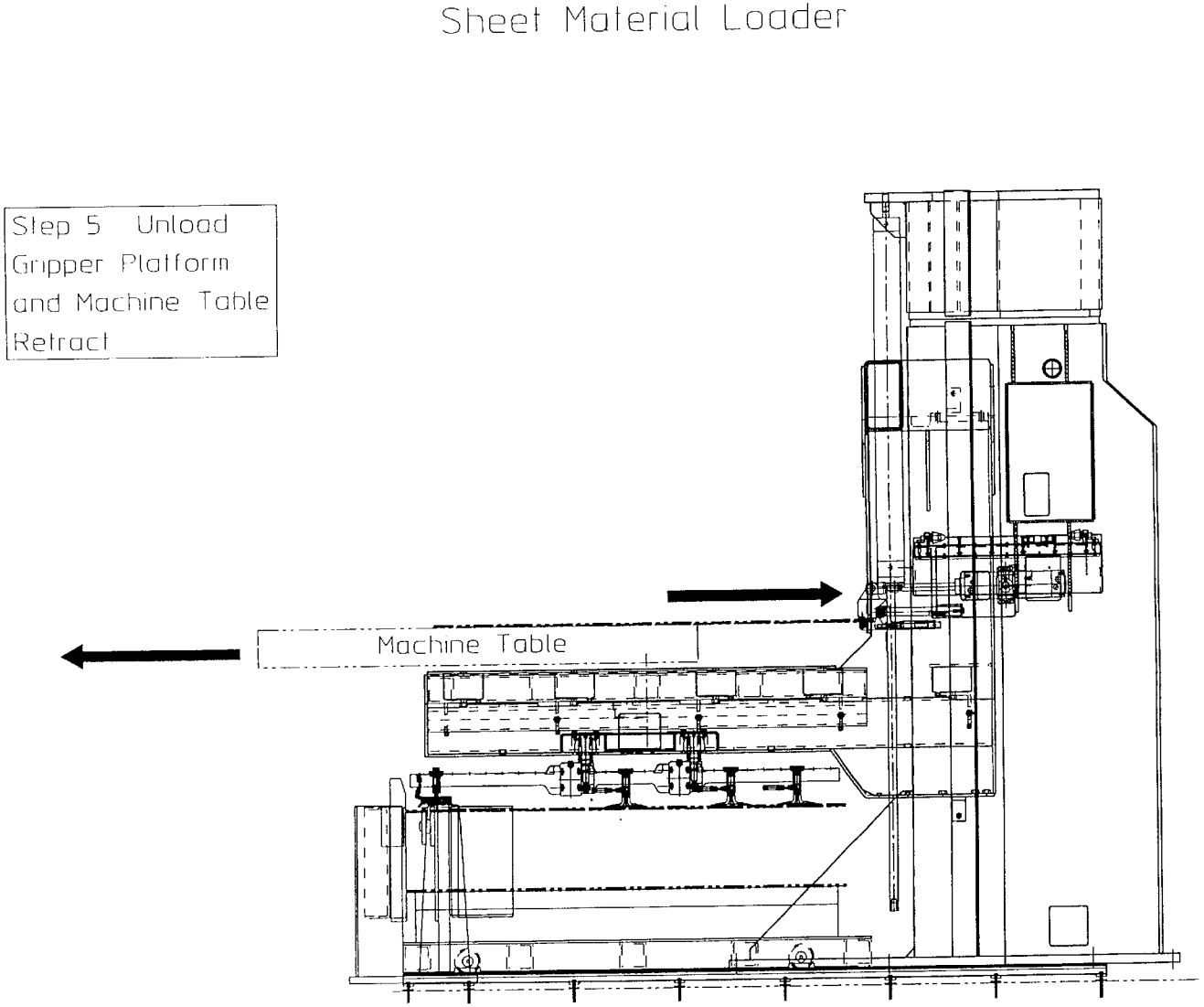
FIG. 8 shows the gripper assembly retracted and the work support table being moved outwardly.
Figure 9:
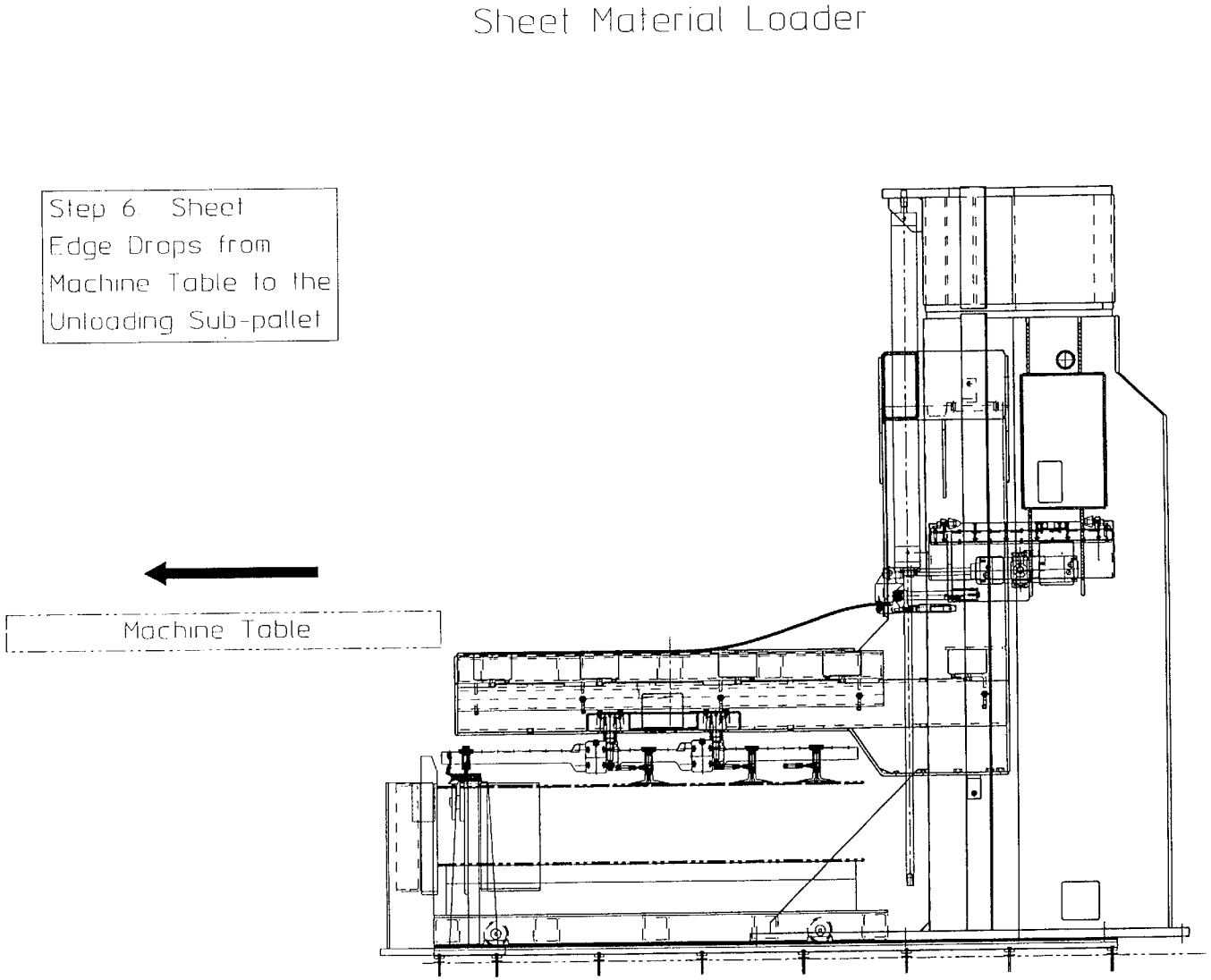
FIG. 9 is a similar view showing the work support table moved outwardly and the processed workpiece dropping onto the upper surface of the platform.
Figure 10:
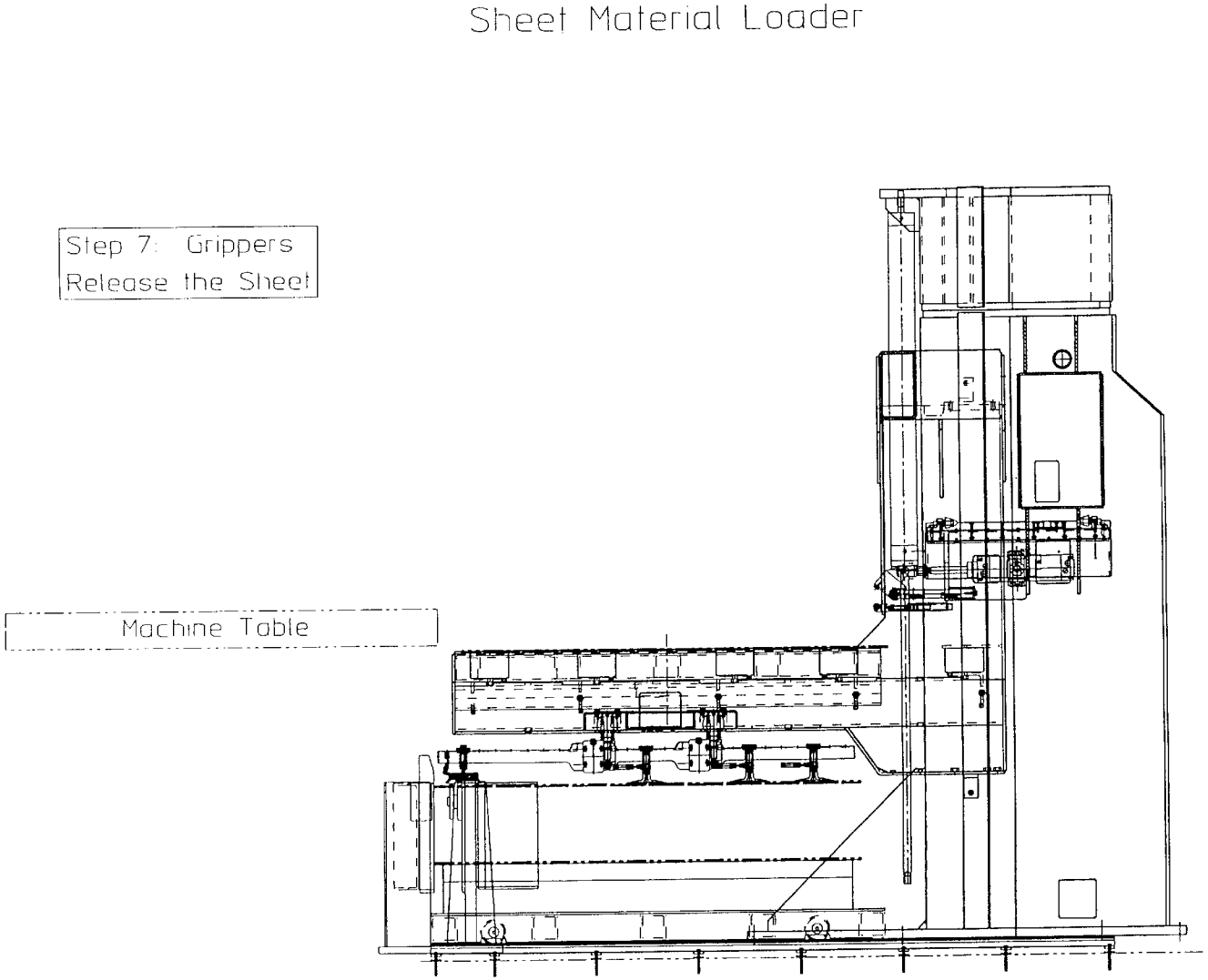
FIG. 10 is a similar view after the grippers have released the processed workpiece.

In FIG. 8, the movable table 14 is being moved outwardly while the grippers 46 hold the processed workpiece 18 in position. As a result, the outer portion of the workpiece 18 drops onto the surface of the platform 32 as seen in FIG. 9. The grippers 46 then release the workpiece 18 and the gripper unit 30 is retracted as seen in FIG. 10.

Figure 11:
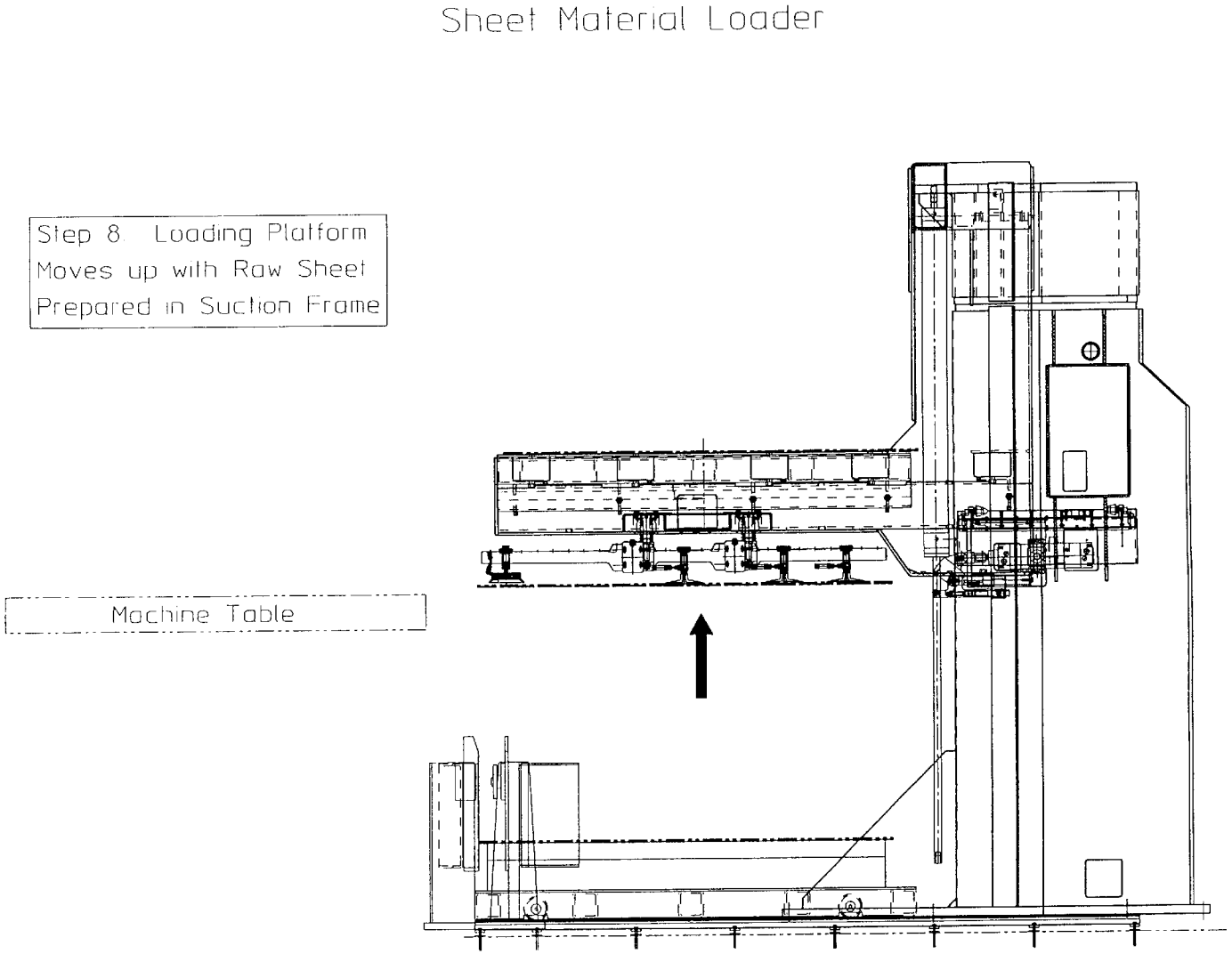
FIG. 11 is a similar view with the platform elevated to a position for discharging the new workpiece onto the work support table.
Figure 12:
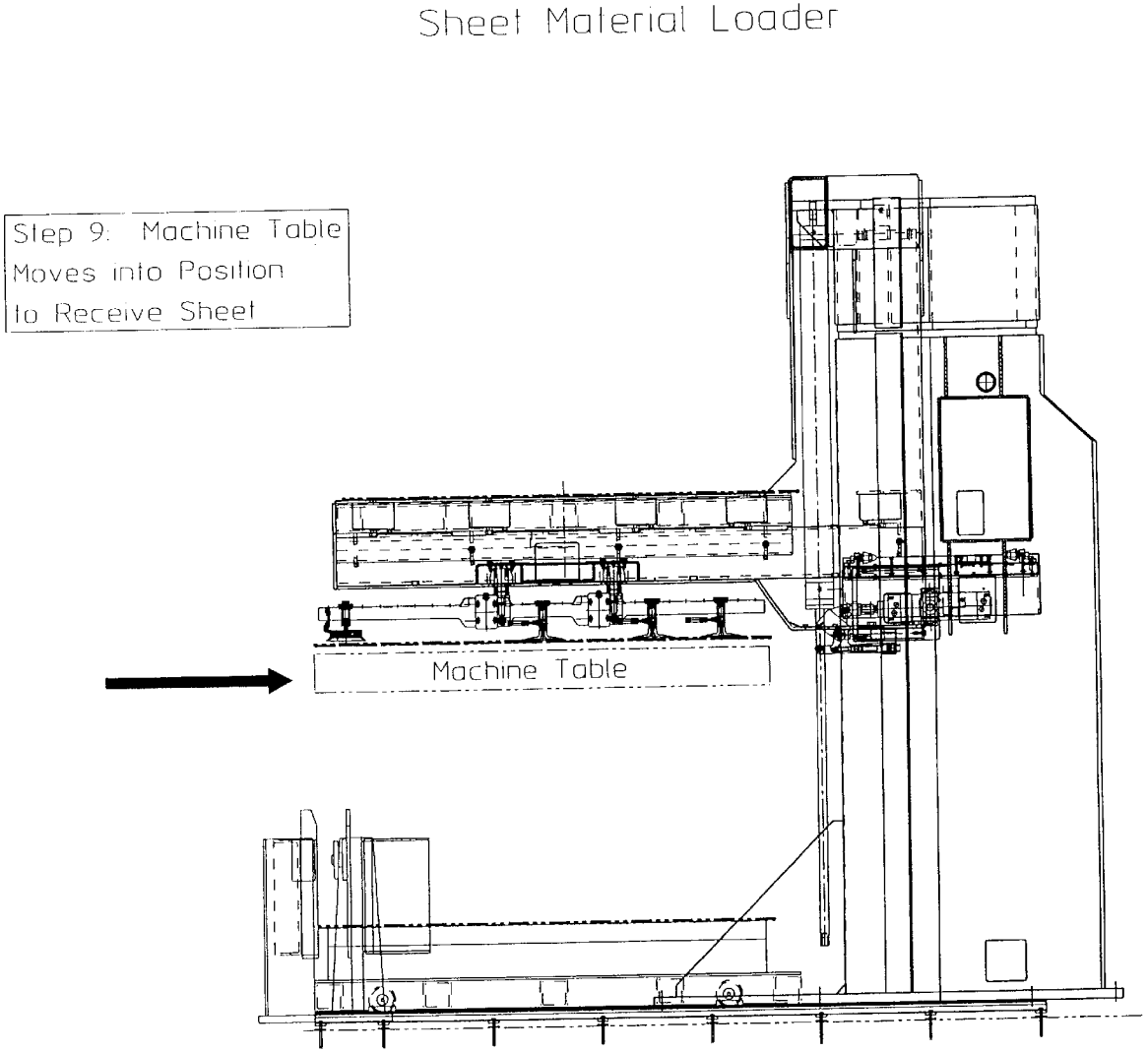
FIG. 12 is a similar view with the work support table moved to a position below the platform to receive the new workpiece.
Figure 13:
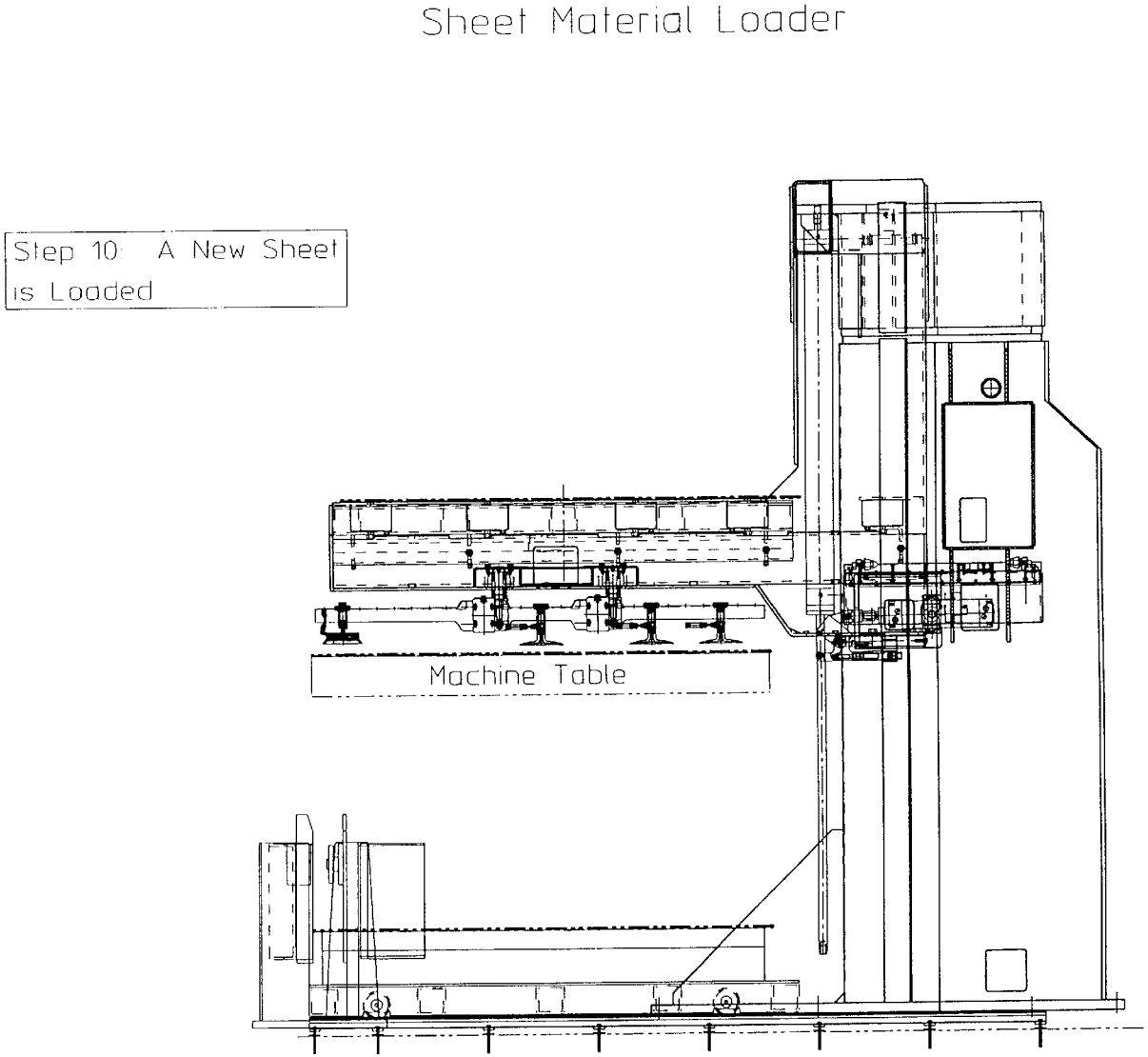
FIG. 13 is a similar view with the new workpiece released onto the work support table.

As seen in FIG. 11, the platform 32 is now moved upwardly and the fresh workpiece 38 to be processed which is held by the suction elements 50 is located at an elevation above the plane of the movable table 14. As seen in FIG. 12, the movable table 14 is now moved inwardly below the fresh workpiece 38, and the suction elements 50 then release the workpiece 38 onto the surface of the movable table 14 as seen in FIG. 13 and the guidance system 16 grips the workpiece 30.

Figure 14:
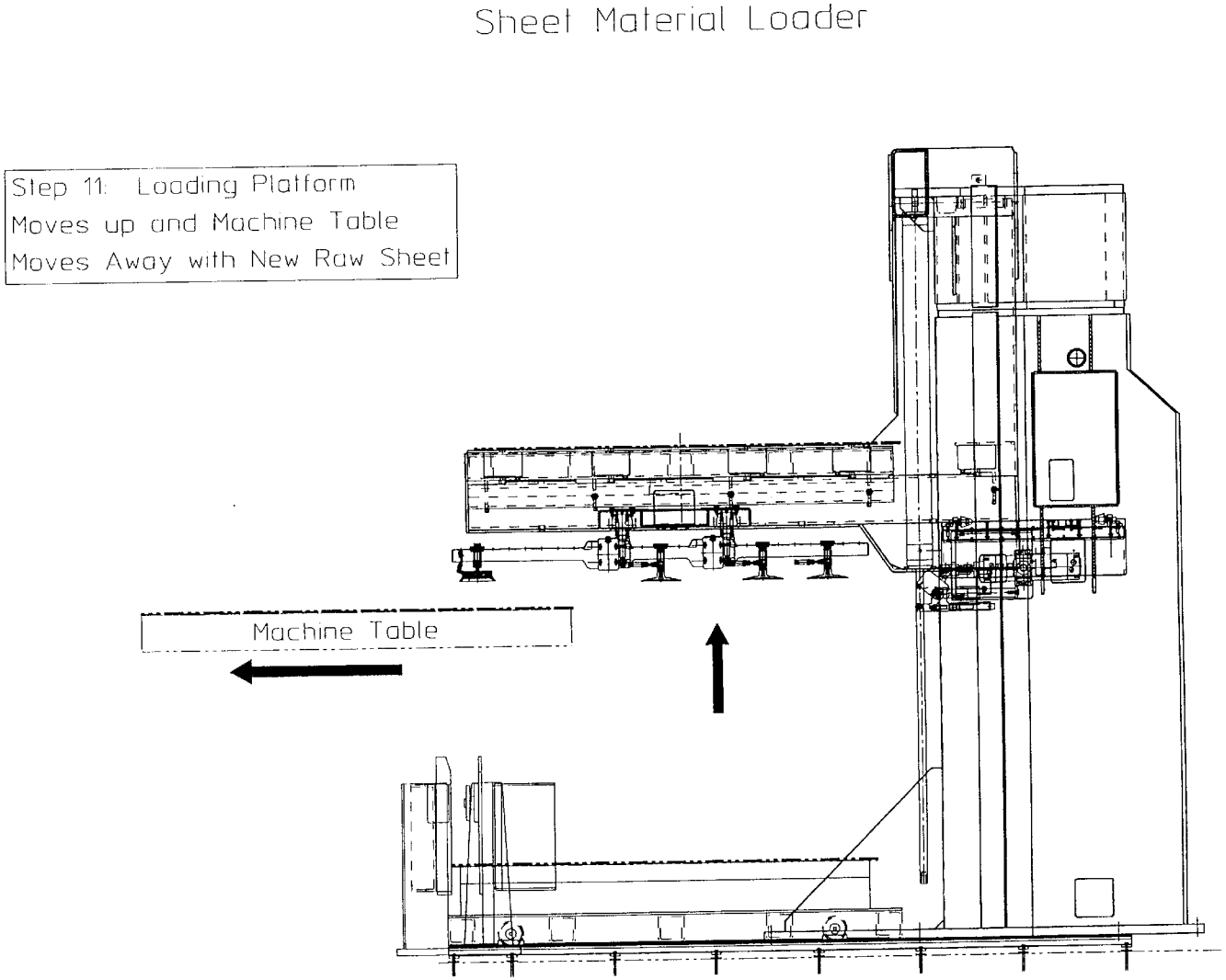
FIG. 14 is a similar view with the platform moving upwardly and the work support table moving outwardly.

The platform 32 is then moved upwardly a short distance to provide increased clearance, and the movable table 14 is moved outwardly as shown in FIG. 14 while firmly gripped by the guidance system 16. The fresh workpiece 38 will be moved by the table 14 into a position for processing by the punch press 12.

Figure 15:
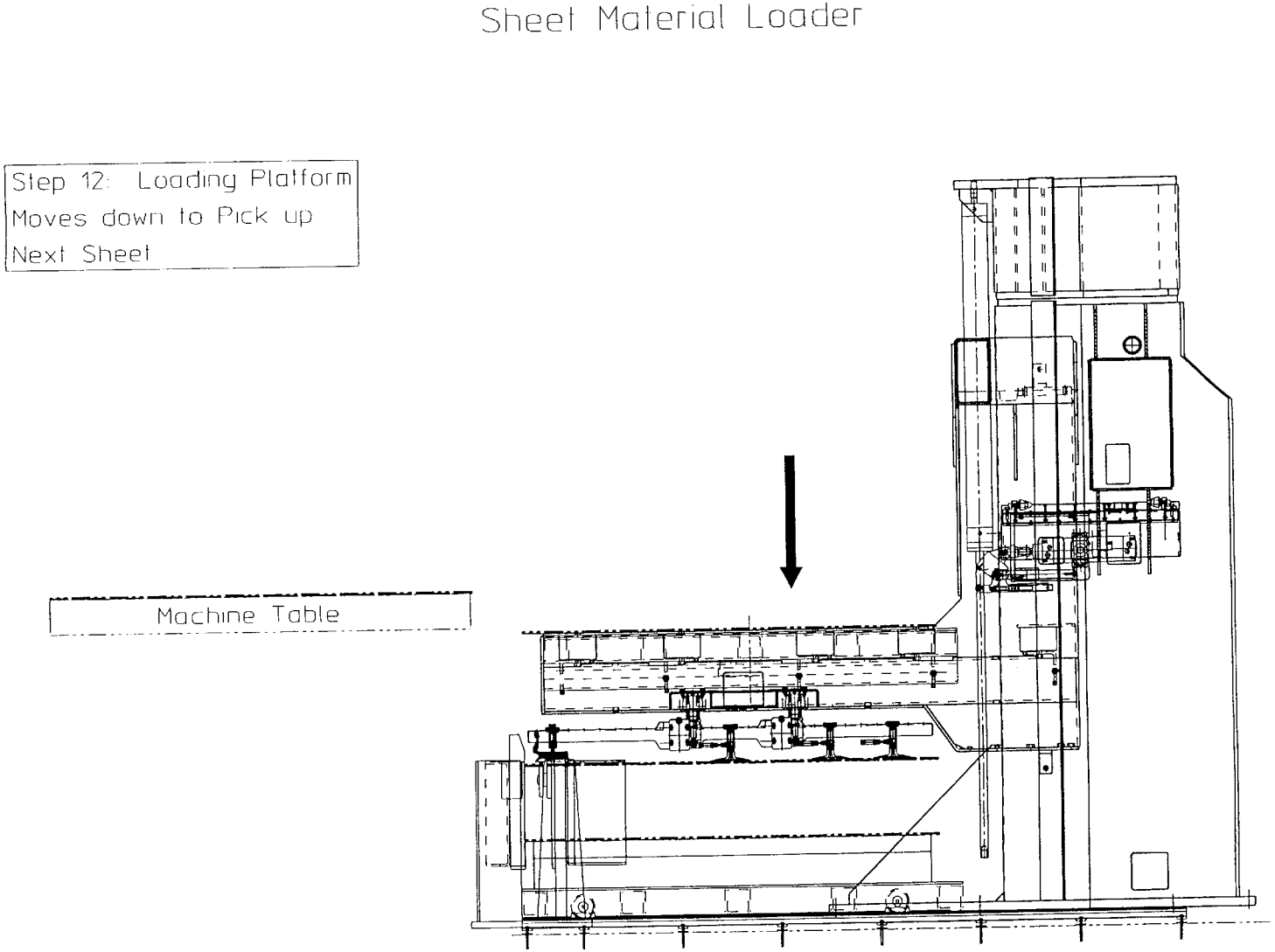
FIG. 15 is a similar view after the platform has moved downwardly and picked up a fresh workpiece.
Figure 16:
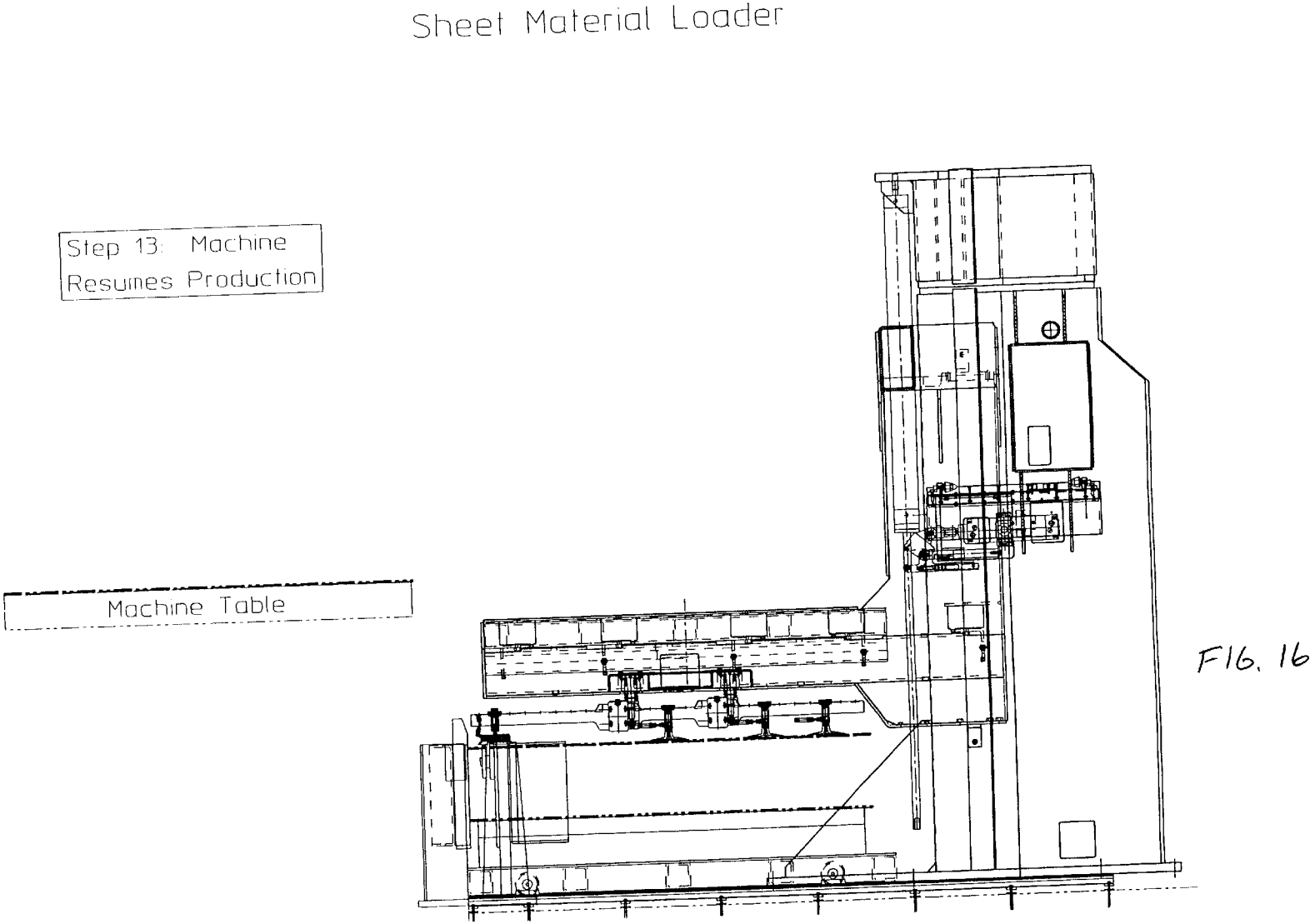
FIG. 16 is a similar view after the platform has delivered the fresh workpiece to the machine table which is its operative position to resume production.

The platform 32 moves downwardly until its suction elements 50 abut the surface of the uppermost workpiece 38 of the stack on the pallet 36 as seen in FIG. 15.

This operational sequence is repeated until the workpieces 38 on the pallet 36 have all been processed. At this time, a fresh pallet with a stack of fresh workpieces 38 is substituted, and the processed workpieces 18 on the platform 32 are removed.

As will be readily appreciated, from the illustrated embodiment of the present invention, the loader and unloader operates highly effectively and rapidly in a series of steps in which the movable platform is elevated and lowered as necessary to receive the processed workpiece from the punch press for storage on its upper surface and to deliver to the punch press a fresh workpiece temporarily retained on its lower surface. The platform of the loader/unloader is moving only in one axis and movement of the workpiece in the horizontal duration on the platform is effected by relatively simple gripper unit which moves outwardly and inwardly relative to the frame of the loader/unloader. With the work table of the machine tool positioned for a normal operation, pallets containing stacks of sheet metal workpieces can be readily placed on the floor underneath the platform and positioned by stops or the like as the pallet is being delivered by a forklift or other transporter.

Thus, the loader/unloader of the present invention requires only two moving elements, namely the platform which moves only vertically and the gripper unit which moves only horizontally while the motion of the work table of the machine tool effects the bulk of the motion of the processed and fresh workpieces in the horizontal direction to unload the processed workpiece and to receive a fresh workpiece for the machining operation.

Although the illustrated embodiment utilizes hydraulic piston/cylinder assemblies for the vertical movement of the platform and the horizontal movement of the gripper unit, it will be appreciated that other drive systems may be employed including electric motors, air cylinders, etc. The opening and closing of the grippers on the gripper unit is conveniently effected by air cylinders although hydraulic units may also be employed as can electric drives.

By providing the rigid frame for the loader/unloader comprised of the uprights and a transverse beam, a rugged assembly is provided to ensure precise motion of the operating elements. Precise positioning of the platform at the several levels may be effected by limit switches or merely precise control of the drive mechanism movement. This is also the case with respect to the motion of the gripper unit in the horizontal direction.

The illustrated embodiment is a relatively accurate representation of a loader/unloader for handling sheet material workpieces 4 feet by 8 feet in conjunction with a high-speed punch press. Obviously the loader/unloader may be varied in size depending upon the needs of a particular machine tool.

Although the unit has been shown in conjunction with a punch press, it will be readily appreciated that it can be also be used in conjunction with a laser cutting machine or other machine tool for processing planar work pieces.

Thus, it can be seen from the foregoing detailed description and the accompanying drawings that the present invention provides a novel loader/unloader for use in conjunction with machine tools. The loader/unloader can be readily fabricated from rugged components and utilizes motion of a platform and a gripper which are conveniently effected under the numeric control system of the machine tool with which the loader/unloader is associated.

Having thus described the invention, what is claimed is:

1. A machine tool installation comprising:

(a) a machine tool having
- (i) a work support table for supporting sheet material for movement in a horizontal plane in X and Y axes, said table having at least a portion which is movable horizontally; and
- (ii) means for moving said portion of said work support table in at least one horizontal axes; and
- (iii) a workpiece guidance system for gripping the workpiece for movement of the sheet material on said work support table, (b) a sheet material loader and unloader adjacent said machine tool and comprising:
- (i) a frame;
- (ii) a platform supported on said frame for vertical movement adjacent said portion of said work support table;
- (iii) means for moving said platform vertically between a position above the horizontal plane of said work support table and a position therebelow;
- (iv) sheet material gripping means mounted on said frame for movement from a position forwardly of said frame to a retracted position to grip a workpiece disposed on said platform;
- (v) means for operating and moving said gripping means;
- (vi) sheet engaging means depending from said platform for engaging the top sheet of a stack of workpieces disposed therebelow for movement vertically with said platform;
- (vii) means for operating said sheet engaging means; and
- (viii) control means controlling said several moving, gripping, engaging and operating means whereby a sheet material workpiece may be moved on said work support table portion of said machine tool to a position over said platform of said loader and unloader for engagement by said gripping means when moved to its forward position to issue the workpiece to drop onto platform when said work table support position is moved away from said platform for movement of the workpiece onto said platform, and whereby said sheet engaging means is operable to engage a sheet, from a pallet of workpieces below said platform when said platform is moved downwardly and said platform is thereafter movable upwardly to move the engaged sheet material workpiece to a position above the plane of said work support table portion and said sheet engaging means deposits the sheet on said work support table.

2. The machine tool installation in accordance with claim 1 wherein said sheet engaging means on said platform comprises (a) suction elements and (b) suction drawing means connected thereto and under control of said control means.

3. The machine tool installation in accordance with claim 1 wherein said workpiece guidance system of said machine tool includes clamps to grasp the adjacent edge portions of a sheet and operable under control of said control means.

4. The machine tool installation in accordance with claim 1 wherein said gripping means includes clamps to grasp the adjacent edge portions of a sheet and operable under control of said control means.

5. The machine tool installation in accordance with claim 1 wherein said machine tool has a computer controlling the operation thereof and including the control means for the moving, gripping and engaging elements of said loader and unloader.

6. The machine tool installation in accordance with claim 1 wherein said frame includes stationary side members and a carriage movably supported on said side members and mounting said platform, said carriage being movable vertically on said side members to effect the vertical movement of said platform.

7. The machine tool installation in accordance with claim 6 wherein said carriage has side members with horizontal guide arms on which said platform is mounted.

8. The machine tool installation in accordance with claim 7 wherein said carriage has a bridge extending over said platform, said sheet material gripping means depends from and is supported by said bridge and movable horizontally thereon.

9. A machine tool installation comprising:

(a) a machine tool having
- (i) a work support table for supporting sheet material for movement in a horizontal plane in X and Y axes, said table having at least a portion which is movable horizontally; and
- (ii) means for moving said portion of said work support table at least one horizontal axes; and
- (iii) a workpiece guidance for gripping the workpiece for movement of the sheet material (b) a sheet material loader and unloader comprising:
- (i) a frame with stationary side members;
- (ii) a movable carriage supported on said side members frame for vertical movement thereon, said carriage having side arms supporting a platform adjacent said . . . of said work support table;
- (iii) means for moving said carriage vertically to move said platform between a position above the horizontal plane of said work support table and a position there below;
- (iv) a bridge on said carriage extending over said platform;
- (v) sheet material gripping means mounted on said bridge for movement from a position forwardly of said frame to a retracted position; said gripping means including clamps to grip the adjacent edge portions of a workpiece;

(vi) means for operating and moving said gripping means;

(vii) workpieces engaging means depending from said platform for engaging the top sheet of a stack of workpieces disposed therebelow for movement vertically with said platform; said sheet engaging means on said platform comprises suction elements and suction drawing means connected thereto;

(viii) means for operating said sheet engaging means; and (ix) control means controlling said several moving, gripping, engaging and operating means whereby a sheet material workpiece may be moved on said work support table portion of said machine tool by said workpiece guidance system to a position over said platform of said loader and unloader for engagement by said gripping means in its forward position for movement of the workpiece onto said platform, and whereby said sheet engaging means is operable to engage a sheet and said platform is thereafter movable upwardly to move the engaged sheet material workpiece to a position above the plane of the work support table portion and said sheet engaging means deposits the sheet on said work support table.

* * * * *